US009222343B2

(12) United States Patent
Menard et al.

(10) Patent No.: US 9,222,343 B2
(45) Date of Patent: Dec. 29, 2015

(54) IN SITU RF HEATING OF STACKED PAY ZONES

(71) Applicants: ConocoPhillips Company, Houston, TX (US); Harris Corporation, Melbourne, FL (US)

(72) Inventors: Wendell P. Menard, Katy, TX (US); Daniel R. Sultenfus, Houston, TX (US); Francis E. Parsche, Palm Bay, FL (US); Mark A. Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 0 days.

(21) Appl. No.: 13/680,181

(22) Filed: Nov. 19, 2012

(65) Prior Publication Data

US 2013/0153210 A1 Jun. 20, 2013

Related U.S. Application Data

(60) Provisional application No. 61/570,337, filed on Dec. 14, 2011.

(51) Int. Cl.
*E21B 43/00* (2006.01)
*E21B 43/24* (2006.01)

(52) U.S. Cl.
CPC ..... *E21B 43/2401* (2013.01); *E21B 43/2408* (2013.01)

(58) Field of Classification Search
CPC .. E21B 43/2401; E21B 36/04; E21B 43/2408
USPC ..... 166/248, 302
See application file for complete search history.

(56) References Cited

U.S. PATENT DOCUMENTS

| | | | | |
|---|---|---|---|---|
| 2,757,738 | A | 8/1956 | Ritchey | |
| 3,522,848 | A | 8/1970 | New | |
| 3,778,701 | A | 12/1973 | Runge | |
| 3,989,107 | A | 11/1976 | Fisher | |
| RE30,738 | E | 9/1981 | Bridges | |
| 4,320,801 | A * | 3/1982 | Rowland et al. | 166/248 |
| 4,373,581 | A * | 2/1983 | Toellner | 166/53 |
| 4,638,863 | A | 1/1987 | Wilson | |
| 5,236,039 | A | 8/1993 | Edelstein | |
| 7,091,460 | B2 | 8/2006 | Kinzer | |
| 2007/0289736 | A1 | 12/2007 | Kearl | |
| 2009/0242196 | A1 | 10/2009 | Pao | |
| 2010/0294488 | A1 * | 11/2010 | Wheeler et al. | 166/248 |
| 2011/0042063 | A1 * | 2/2011 | Diehl et al. | 166/60 |
| 2011/0278001 | A1 * | 11/2011 | Schneider et al. | 166/272.3 |

FOREIGN PATENT DOCUMENTS

| | | |
|---|---|---|
| WO | WO2010107726 | 9/2010 |
| WO | PCT/US12/65754 | 11/2012 |

* cited by examiner

*Primary Examiner* — John Kreck
(74) *Attorney, Agent, or Firm* — Boulware & Valoir

(57) ABSTRACT

A method of heating stacked pay zones in a hydrocarbon formation by radio frequency electromagnetic waves is provided. In particular, radio frequency antenna array having multiple antenna elements are provided inside a hydrocarbon formation that has steam-impermeable structure. The antenna elements are so positioned and configured that the hydrocarbons in the place where conventional thermal methods cannot be used to heat due to the steam-impermeable structure can now be heated by radio frequency electromagnetic waves.

16 Claims, 7 Drawing Sheets

IN SITU RF HEATING OF STACKED PAY ZONES

PRIORITY CLAIM

This application claims priority to 61/570,337, filed Dec. 14, 2011, and incorporated by reference herein in its entirety.

FIELD OF THE INVENTION

The invention relates to the production of heavy oils and bitumens from stacked pay zones using radio frequency radiation (RF) to heat and mobilize the oil.

BACKGROUND OF THE INVENTION

The production of heavy oil and bitumen from a subsurface reservoir is quite challenging. One of the main reason for this is the initial viscosity of the oil reservoir is often greater than one million centipoise. Therefore, the removal of the oil from the subsurface is typically achieved by either surface mining or by the introduction of energy into the reservoir such that the reservoir is heated enough to lower the viscosity of the oil and allow it to be produced. Currently the preferred method of energy transfer to the reservoir is steam injection.

One limiting factor in the economic production of viscous oil using steam is the heterogeneous nature of the reservoir where heavy oil is found. FIG. 1 shows an example of a bitumen reservoir in Northern Alberta. As shown, there are numerous oil bearing sand layers separated by shale and mudstones. The applicability of steam injection is often limited by the impermeable shale layers and mudstones that act as barriers to vertical flow. These barriers prevent the steam from contacting sufficient amounts of heavy oil or bitumen and reducing its viscosity enough to be produced. The impermeable layers effectively compartmentalize the reservoir into thin sub-reservoirs that cannot be economically developed because of the economic requirement for significant reservoir thickness.

Vertical wells can allow the production from multiple pay zones by contacting all of the stratified layers, but they require a more efficient form of energy transfer to the reservoir in order to provide economic flow rates. As a result, current production of heavy oil and bitumen using thermal methods is limited to fairly homogeneous sand formations with good vertical permeability. Laterally continuous shale or muds can significantly reduce the amount of the resource that is considered producible. This leaves billions of barrels of oil stranded in compartmentalized reservoir sections. As an example, the McMurray formation in the Athabasca region of Alberta, Canada can have a thickness of over ninety meters. Of that, usually less than half is currently considered economically producible due to stratification of the reservoir by shale layers or mudstones.

Unlike steam, electromagnetic energies can penetrate impermeable shale and mudstone layers to heat additional hydrocarbon layers beyond. Thus, using RF radiation to target these zones, the reservoirs may be produced with vertical, slant or horizontal wells. RF has already been used in the art, although RF methods have yet to reach their full potential and are still being developed.

U.S. Pat. No. 2,757,738, for example, is a very early publication disclosing a method for heating subsurface oil reservoir bearing strata by radio frequency electromagnetic energy, where the RF electromagnetic energy is generated by a radiator within a vertical well bore. The antennas of this method are not immersed in the ore for extended distance because the well bores are vertically drilled. Additionally, the vertically drilled well bores have inherent limitations on separating the charges between horizontal earth strata.

U.S. Pat. No. 3,522,848 discloses radiation generating equipment for amplifying the oil production in a natural reservoir. In essence radio frequency electromagnetic waves are used to heat the dry exhaust gas (comprising $CO_2$ and nitrogen) of an internal combustion engine, and the heated gas is subsequently used to heat the reservoir to reduce the viscosity of the hydrocarbons contained in the natural reservoir.

U.S. Pat. No. 4,638,863 discloses a method for stimulating the production of oil by using microwaves to heat a non-hydrocarbonaceous fluid, such as salt water, surrounding a well bore, and the heated non-hydrocarbonaceous fluid will in turn heat the hydrocarbonaceous fluid in the same formation.

U.S. Pat. No. 5,236,039 provides a system for extracting oil from a hydrocarbon bearing layer by implementing RF conductive electrodes in the hydrocarbon layer, the RF conductive electrodes having a length related to the RF signal. The spacing between each RF conductive electrode and the length of such electrodes are calculated so as to maximize the heating effect according to the frequency of the RF signal. However, the inventors' experiences indicate that standing wave patterns do not form in dissipative media, such as hydrocarbon ores, because the energy will be dissipated as heat long before significant phase shift occurs in the propagation of electromagnetic energies. Thus, this method is of limited use.

U.S. Pat. No. 7,091,460 discloses a method for heating a hydrocarbonaceous material by a radio frequency waveform applied at a predetermined frequency range, followed by measuring an effective load impedance initially dependent upon the impedance of the hydrocarbonaceous material, which is compared and matched with an output impedance of a RF signal generating unit. An important aspect of this invention relates to the fact that certain hydrocarbonaceous earth formations, for example unheated oil shale, exhibit dielectric absorption characteristics in the radio frequency range. Unlike most prior art electrical heating in situ approaches, the use of dielectric heating allegedly eliminates the reliance on electrical conductivity properties of the formations. Thus, the method supposedly allows more uniform heating and deeper penetration.

US20070289736 discloses a method of in situ heating of hydrocarbons by using a directional antenna to radiate microwave energy to reduce the viscosity of the hydrocarbon. The method preferably applies sufficient energy to create fractures in the rock in the target formation, so as to increase the permeability for hydrocarbons to flow through the rough and be produced. However, directional antennas are impractical at the frequencies required for useful penetration, because the instantaneous skin depth of penetration may be too short. For example a 2450 MHz electromagnetic energy in rich Athabasca oil sand having conductivity of 0.002 mhos/meter is 9 inches. Thus, this method is also of limited use.

WO2010107726 discloses a process for enhancing the recovery of heavy hydrocarbons from a hydrocarbon formation. Microwave generating devices are provided in horizontal wells in the formation, and a microwave energy field is created by the microwave generating devices, so that the viscosity of the hydrocarbons within the microwave energy field can be reduced and more readily produced. Electric waves must be generated for this method to work, limited its usefulness.

RE30738 describes another RF method wherein in situ heat heating of heavy oil occurs using an array of RF antenna inserted in said formations and bounding a particular volume of the oil field formations. AC currents establish electric fields in said volume, the frequency being selected as a function of the volume dimensions so as to establish substantially non-radiating electric fields, which are substantially confined in said volume. Using this method, volumetric dielectric heating of the formations will occur to effect approximately uniform heating of said volume. However, this method requires a three-row conductor design where the outer two rows are longer than the central row, so as to confine the heating between the three rows. Additionally, to achieve confinement, the spacing of conductors in the same row is less than a quarter wavelength apart, and preferably less than an eighth of a wavelength apart.

US20090242196 describes a method of producing heavy oil by determining conductivity and permittivity of the hydrocarbon-bearing rock and the overburden layer, as well as a roughness of the boundary between the hydrocarbon-bearing rock and the overburden layer. These parameters are used to construct a computer model based upon modeling the formation as a rough-walled waveguide. The model simulates propagation of radio frequency energy within the hydrocarbon-bearing rock, including simulation of radio frequency wave confinement within the hydrocarbon-bearing rock, at several frequencies and temperatures, and the retorting frequency is selected based upon the results. Radio frequency couplers are installed into at least one borehole in the hydrocarbon-bearing rock and driven with radio frequency energy to heat the hydrocarbon-bearing rock. As the rock heats, it releases carbon compounds and these are collected.

While superficially similar to the invention, reflection from rock is not preferentially used herein. One may notice in FIG. 10 below, that heating is following the rock layer. If reflection were dominant, the heating would be displaced from the rock layer, and this is not occurring. The invention is also novel relative to US20090242196 as we use horizontal directional drilling to orient the heating portion of our antennas horizontally in the horizontally planar hydrocarbon bearing strata. In addition, we use a grid pattern with adjacent planes of antennas to produce flux lines that are aligned in opposite directions to each other to prevent cancellations.

None of the abovementioned literature discloses a method or system that addresses the issue of non-producible hydrocarbons when the hydrocarbon formation is stratified with steam-impermeable shale or mudstones, especially by heating the formation with joule-heating induced by eddy currents. Thus, what is needed in the art is a method of efficiently heating heavily stratified formations.

SUMMARY OF THE INVENTION

Dielectric heating, also known as electronic heating, RF heating, high-frequency heating and diathermy, is the process in which radio wave or microwave electromagnetic radiation heats a dielectric material. This heating is caused by electric dipole rotation, as the dipoles attempt to align with a changing EM field.

Many people have attempted to design in situ heavy oil heating methods that rely on dipole rotation. However, the method has been limited because pure hydrocarbon molecules are substantially nonconductive, of low dielectric loss factor and very low magnetic and electric moments. Thus, pure hydrocarbon molecules themselves are only fair susceptors for RF heating, i.e. they may heat only slowly in the presence of RF fields. Furthermore, heating tends to be non-uniform, occurring close to the RF emitter, and falling off rapidly. Instead, water in the formation heats preferentially, until it evaporates, and then efficiency of heating drops significantly.

However, the application of a RF electromagnetic field can also cause inductive heating or joule heating. Generally speaking, radio frequency induction heating is the process of heating a material by electromagnetic induction, where eddy currents are generated within the material following Faraday's law and resistance leads to Joule heating of the material in the form of temporal and spatial volumetric heating. Since inductive heating is driven by changes in the magnetic field, heat may also be generated by magnetic hysteresis losses in materials that have significant relative permeability.

Generally, the invention takes advantage of Joule heating of in situ heavy oil formations by providing a special arrangement of RF emitters, wherein a plurality of RF emitters are staggered such that each adjacent emitter is running AC current of RF frequencies in different directions at any given time. This provides the possibility of stacking magnetic field between two adjacent RF emitters, which enhances eddy currents within the formation to in situ heat up the oil formation underneath rock strata.

In practical terms, the amplitude of the field between two antennas can be increased up to a factor of 2 compared to the field generated by a single antenna. The power is proportional to the square of the field amplitude, and so can be increased up to a factor of 4 using this method. On the other hand, if the AC currents were entirely parallel, the induced magnetic fields between them would act against each other, partially cancelling out and decreasing the radiated power. The arrangement of emitters is extended into an array by switching the direction of current in each additional antenna added to the array.

The use of the word "a" or "an" when used in conjunction with the term "comprising" in the claims or the specification means one or more than one, unless the context dictates otherwise.

The following abbreviations are used herein:

| | |
|---|---|
| RF | Radio frequency |
| SAGD | Steam assisted gravity drainage |

As used herein "heavy oil" is defined as a form of crude oil that has heavy molecular weight and generally has a viscosity in the million-centipoise range under natural reservoir conditions. The term includes bitumens and polyaromatic hydrocarbons, and combinations thereof.

The term "steam impermeable structure" refers to geological structures within a hydrocarbon formation that are impermeable to steam, so that the energy transfer normally provided by steam to reduce the viscosity of the hydrocarbons is far less efficient. Such structures include mudstone and shale layers.

The term "radio frequency" or "RF" refers to a frequency range of electromagnetic waves through which energy can be conveyed, and as used in the present invention energy is transferred in the electromagnetic waveform. There is no limitation to the frequency range of the electromagnetic waves used in the present invention, as long as energy can be efficiently transferred. RF is a rate of oscillation in the range of about 30 kHz to 300 MHz, which corresponds to the frequency of electrical signals normally used to produce and detect radio waves. RF usually refers to electrical rather than mechanical oscillations, although mechanical RF systems do exist.

Microwave (MW) radiation refers to a frequency range of electromagnetic waves from 300 MHz-300 GHz, but MW radiation has less depth-of-penetration than RF for this application, and is not a preferential range of frequencies. A MW array would have to be impractically denser than an RF array, using many more antennas for the same formation, although it is one potential embodiment.

The term "eddy current" refers to an electrical current induced in a conductor. Eddy currents (also called Foucault currents) are produced for a single electrical current loop following Faraday's law: $i=-d(AB)/dt$, where i is the induced current, A is the area enclosed by the current loop, and B is the magnetic field. Faraday's law implies the conditions under which eddy currents will be generated: first, due to any relative motion of the conductor and magnetic field which results in a change in the area A enclosed by the current loop; or second, by the variation of the magnetic field B. The latter condition is satisfied by application of RF radiation, which imposes a time-varying magnetic field.

The term "Joule heating" refers to resistive heating within a conductor. As used here, "Joule heating" is synonymous with "induction heating", or resistive heating generated by eddy currents induced by an applied time-varying magnetic field. Of course, dielectric heating may occur at the same time, but uses of the terms "Joule heating" or "inductive heating" are intended to convey that Joule heating predominates over dielectric heating.

The term "staggered" antennas, emitters or RF transmitters means that horizontal antennas are placed in a spatial arrangement in which adjacent antennas are "anti-parallel," such that the phase of the AC current in adjacent antenna is offset by approximately 180°, i.e., the currents in two adjacent antennas at any point in time are generally opposite in direction but equal in magnitude. The chosen antenna placement serves to maximize the heating effect and to ensure even heating across the pay zone, without self-heating of the adjacent antennas. The antenna placement need not be perfectly parallel between antennas, as antenna placement will of course vary due to reservoir conditions and placement of surface structures, but includes considerably variation.

The current invention utilizes RF radiation from horizontal antennas to introduce energy to the reservoir and uses wells (vertical, slant or horizontal) to produce the heated fluid from stratified regions of reservoirs. Such stratified regions are commonly called "stacked pay zones" or "multiple pay zones."

The inventive method differs significantly from the prior art in the arrangement of the antenna array and in the selection of Joule heating over dielectric heating.

More specifically, the present invention includes a process using production wells (vertical, slant or horizontal) drilled into the stacked pay zones that are to be heated with induction heating induced by RF electromagnetic energies produced by staggered antennas. The use of RF inductive heating will cause the viscosity of the heavy oil or bitumen to be sufficiently reduced to allow for flow to the production wells. The RF antennas can be placed in, above, below or on either side of the wells.

Preferential spacing of the antennas is determined based on an appropriate radiation transmission length into the material. Without limiting the determination of preferential spacing to specific methods, the half-power depth, 1/e power depth, half-amplitude depth, and the skin depth are all examples of appropriate parameters. The determination of such parameters is made via a "Beer's Law" approach. Beer's law of absorption, as usually stated, provides a method for determining linear absorption in homogeneous media:

$$P(z) = P(0)e^{-\alpha z} = P(0)e^{-z\sqrt{\pi\mu_0\sigma f}}$$

P is transmitted power, z is the linear distance, $\alpha$ is the absorption coefficient. For RF radiation, the absorption coefficient can be expressed in terms of the magnetic permeability of the medium ($\mu_0$), the conductivity of the medium ($\sigma$) and the frequency of the EM radiation (f). Under this linear assumption, we can estimate the attenuation distance as follows:

$$z \approx \frac{1}{\sqrt{\pi\mu_0\sigma f}} \ln \frac{P(0)}{P(r)}$$

The 1/e power depth is found when $P(r)=P(0)/e$; i.e. when $z \approx 1/\sqrt{\pi\mu_0\sigma f}$. The half-power depth is found when $P(r)=P(0)/2$; i.e. when $z \approx (\ln 2)/\sqrt{\pi\mu_0\sigma f}$.

An antenna spacing of about one to three times the attenuation distance is preferred for this invention; the spacing must be far enough apart to avoid sympathetic effects (arcing, mutual heating of antennas) between adjacent emitters, but must remain close enough to provide enhanced heating and uniform field density within the pay zone between adjacent emitters.

For example, for a frequency of 30 kHz and a reservoir (oil sand) conductivity of 0.002 mho/m, the 1/e power depth is ≈65 m. For the same frequency in shale, the 1/e power depth is only 6 m. In general, the preferably horizontal antennas spacing distance is about 1-50 meters, depending on antennas and reservoir characteristics.

Alternatively, if a given distance z is selected for an antenna spacing in a given pay zone with conductivity $\sigma$, the above equations suggest a preferential RF frequency:

$$f \approx \frac{c}{\pi\mu_0\sigma z^2}$$

where c is a constant derived from the distance parameter, and can range from about 0.5-10

The RF process described in this invention can be used with primary production or coupled with steam injection, water injection, gas injection, solvent injection, surfactant injection, high pressure air injection, polymer injection or a combination of these processes to improve the efficiency.

One example of well placement is shown in FIG. 2. This configuration used a horizontal well with an RF antenna placed below vertical injection or production wells in order to heat the stacked pay zones. For clarity, only a single antenna is shown in FIG. 2 to demonstrate the production concept; however, the arrangement remains valid if applied to a larger, parallel horizontal array of antennas; in that case, heating would be enhanced between adjacent antennas by selecting the AC phase as previously described.

In more detail, the invention is a method of enhancing production of hydrocarbons in a hydrocarbon formation having steam-impermeable structures, by providing producer wells within the hydrocarbon formation, measuring preferable electrical characteristics, such as conductivity or permittivity, of the hydrocarbon pay zone, and providing an RF antenna array within the hydrocarbon pay zone at places having a preferable electrical characteristics, wherein the RF antenna array is connected to an alternating electrical current source.

The preferable electrical characteristic is electrical conductance, which is desired to be low. The RF antenna array is positioned near the more electrically conductive underground regions. The term "more electrically conductive underground regions" refers generally to underground regions that have higher electric conductivity than other regions, such as the shale or rock zones. Electric conductivity and several other characteristics such as thermal conductivities, thermal heat capacities, and relevant densities of the oil and rock strata are used to characterize the formation composition and possible rock structure.

In a preferred embodiment, the measured electrical conductivity ranges from 0.0001 mhos/meter to 0.01 mhos/meter in the oil sand, and 0.05-0.5 mhos/meter in the rock strata.

The next step is radiating RF energies by the RF antenna array to heat at least a portion of the hydrocarbons by induction heating caused by eddy currents within the hydrocarbons having the preferable electrical characteristic, then producing the hydrocarbons through the producer wells. The RF antenna array comprises a plurality of staggered antenna elements placed at portions of the hydrocarbon formation. In some embodiments, the antennas are placed nearby the steam-impermeable structures.

Preferred antenna designs are antenna that can be inserted into a linear bore shaft, generating radiation in a cylindrical geometry. Preferred antenna designs include, but are not limited to linear dipoles, linear half-wavelength dipoles, linear quarter-wavelength dipoles, folded linear dipoles, and coaxial dipoles.

Also preferred is where the RF antenna array has a plurality of antenna elements, which can be linear, and should be positioned parallel to each other. The antenna elements can be configured in a horizontal, vertical or slant configuration, preferably horizontal, within the hydrocarbon formation, and preferably are positioned inside, beside or around the producer wells.

In another embodiment, the invention is a system for enhancing production of hydrocarbons in a hydrocarbon formation having steam-impermeable structures, comprising producer wells having substantially vertical portions in the hydrocarbon formation and substantially non-vertical portions within the hydrocarbon; together with an interdigitated radio frequency antenna array having a plurality of antenna elements connected to at least one current source through conductive wirings.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim. The phrase "consisting essentially of" is closed, not allowing the additional of other elements. The phrase "consisting essentially of" occupies a middle ground, excluding material elements, but allowing non-material elements.

BRIEF DESCRIPTION OF THE DRAWINGS

FIG. 8B shows the interdigitated antenna from right angles to FIG. 8.

DESCRIPTION OF EMBODIMENTS OF THE INVENTION

Generally, speaking, the invention involves placing RF antennas into pay zones, preferably an array of horizontal antennas, and then generating an electromagnetic field of RF so as to create eddy currents that then heat the reservoir. Since the RF EM field is calculated to penetrate about 65 meters in oil sand for an RF frequency of 30 kHz, the antennas array is preferably spaced at as low as about 5 meters and as much as about 100 meters, though the actual number will vary depending on both reservoir and antennas characteristics as previously described, as well as water or steam absorbing the current.

Under certain assumptions (uniform material, uniform magnetic field, no skin effect, etc.) the total power transferred in inductive heating due to eddy currents can be calculated from the following equation for thin wires ("thin" means the radius of the wire is much less than the length of the wire, which is true for the antennas considered here):

$$P = \frac{\pi^2 B_p^2 d^2 f^2}{12\rho D}$$

Here, P is power dissipation (W/kg), $B_p$ is peak magnetic field (T), d is the diameter of the wire (m), f is the frequency (Hz), ρ is the resistivity of the medium (Ωm), and D is the specific density (kg/m$^3$). This equation is a form of Ohm's law: $P=V^2/R$. If the resistivity of the medium is too high, power will be lower because less inductive current will flow.

It should be borne in mind that these equations are valid only under the so-called "quasi-static" conditions, where the frequency of magnetization does not result in the skin effect, i.e. the electromagnetic wave fully penetrates the material.

Therefore, the following things usually increase the size and effects of eddy currents:

stronger magnetic fields—increases flux density B faster changing fields (due to faster relative speeds or otherwise)—increases the frequency f, which can increase power transfer; however, high f also increases attenuation of the radiation, limiting the range of transfer. The greatest penetration of the EM radiation into the oil sand was calculated to occur at a low RF frequency, about 30 kHz.

thicker materials—increases the thickness d lower resistivity materials (e.g., hydrocarbons, salt water, etc.).

Figure 1:
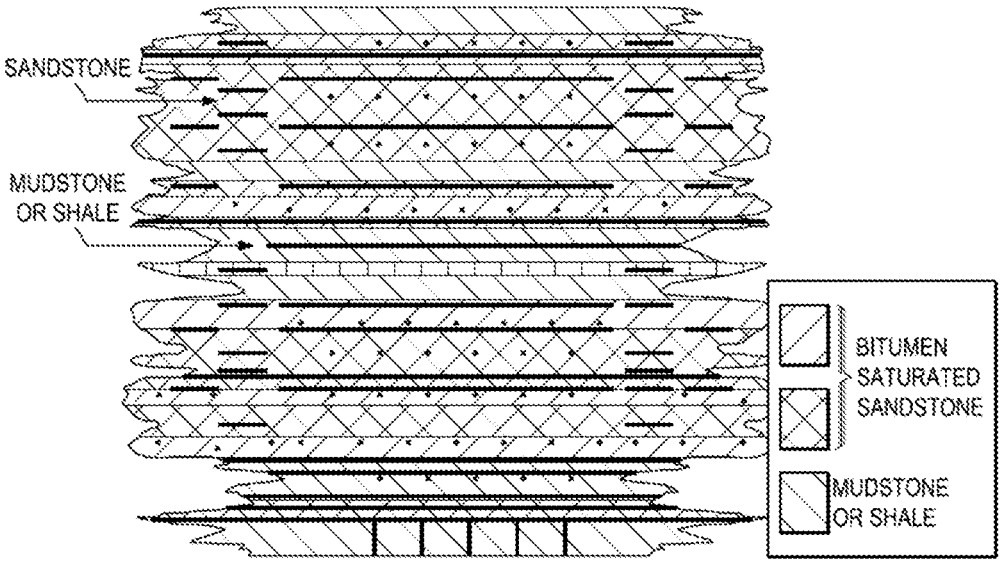
FIG. 1 is an illustration of a stratified hydrocarbon pay zone that is typical of sandstone reservoirs.
Figure 2:
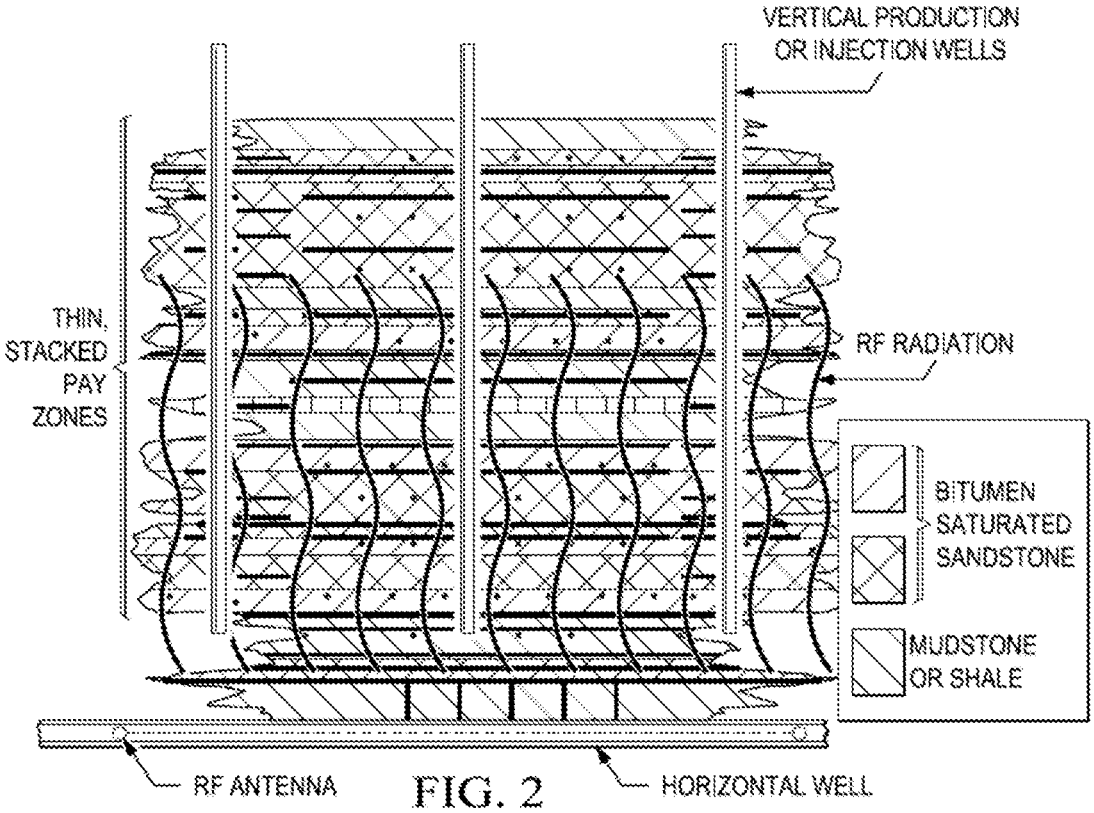
FIG. 2 is an illustration of a well configuration that utilizes vertical RF radiation to assist the oil production through vertical producer/injection wells.
Figure 3:
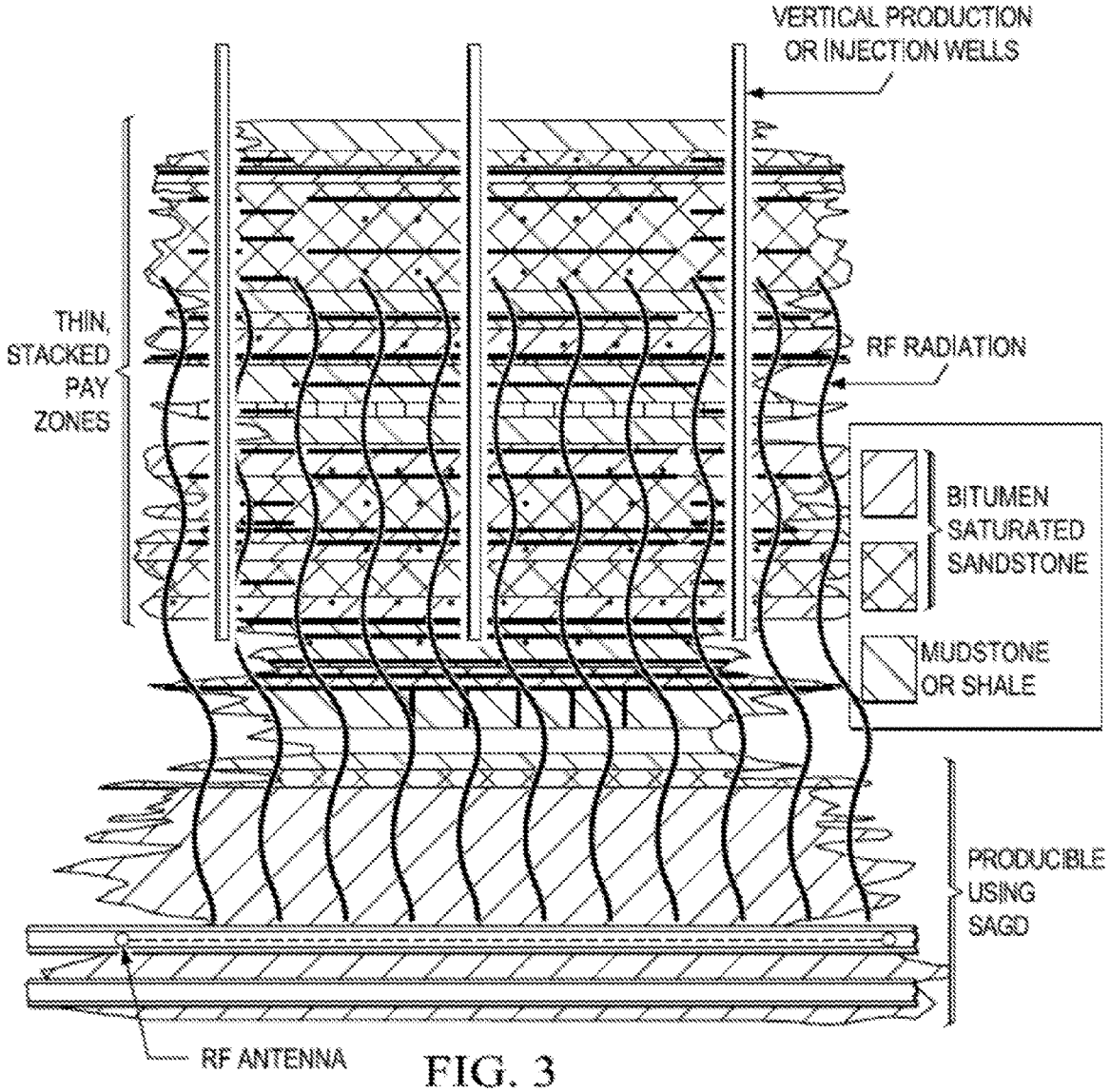
FIG. 3 is an illustration of a variation of FIG. 2 where SAGD is coupled with RF radiation to assist the oil production through vertical producer/injection wells. The red line indicates a steam pipe (as would be used in a SAGD configuration). The green line indicates a production well. The blue dotted line represents the RF antenna. The red oscillating curves indicate the directionality and extent of the emitted RF radiation.

The method of the present invention can also be coupled with other thermal processes in order to create a synergetic effect between the two. One such embodiment is shown in FIG. 3. This method couples with Steam Assisted Gravity Drainage (SAGD) with the production of the stacked pay zones that overlay a zone considered producible using SAGD. Heat from the SAGD steam chamber is transferred to the overburden layers through conduction and assisted by the induction of eddy currents in heating the thin pay zone layers. This has the ability to make SAGD more efficient as the energy that is normally lost to the overburden layers from the steam chamber now assists the eddy currents in heating the superimposed stacked pay zones and the RF antenna can aid in a more rapid steam chamber development in the SAGD process.

Results from numerical simulations show the effectiveness of RF radiation and how it can improve recovery from an isolated pay zone. FIG. 4 shows the oil saturation of a representative Athabasca reservoir from Northern Alberta with an impermeable shale layer near the top of the reservoir. The well configuration is similar to that seen in FIG. 3. The top section, which does not have communication with the bottom section, has been completed with a water injector on one edge of the reservoir and a production well on the opposite side.

Figure 4A:
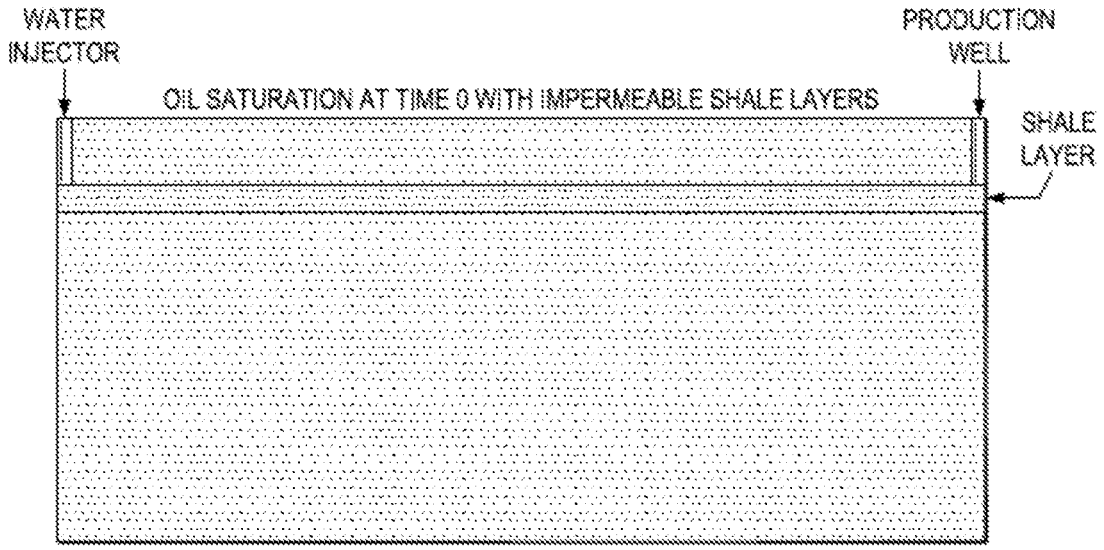
FIG. 4A-B is a simulation of oil saturation of a representative Athabasca reservoir from North Alberta before 4A and after 4B 7 years of production. The green area indicates successful oil extraction.
Figure 4B:
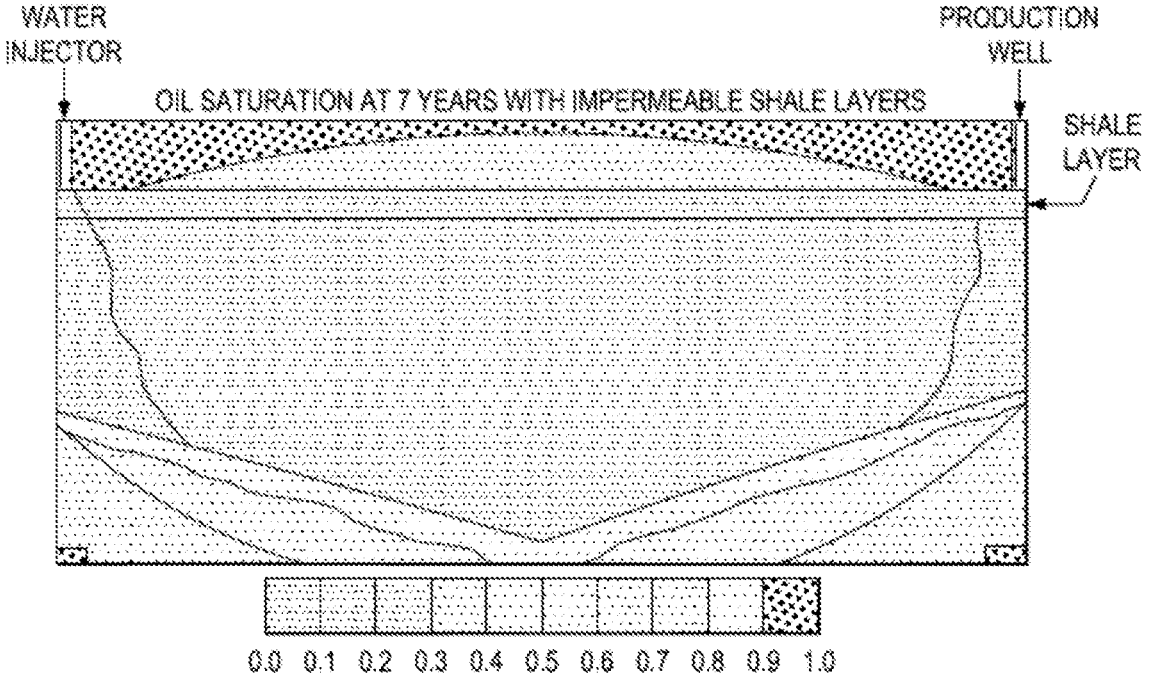

FIG. 4*a* shows the virgin reservoir prior to the start of SAGD. Seven years of SAGD production were simulated and the resulting oil saturation is shown in FIG. 4*b*. Due to the impermeable layer, the upper section of the reservoir has not drained using SAGD. This section is also unable to be produced via water flooding due to the oil's high viscosity, leaving significant unrecovered oil behind.

Figure 5A:
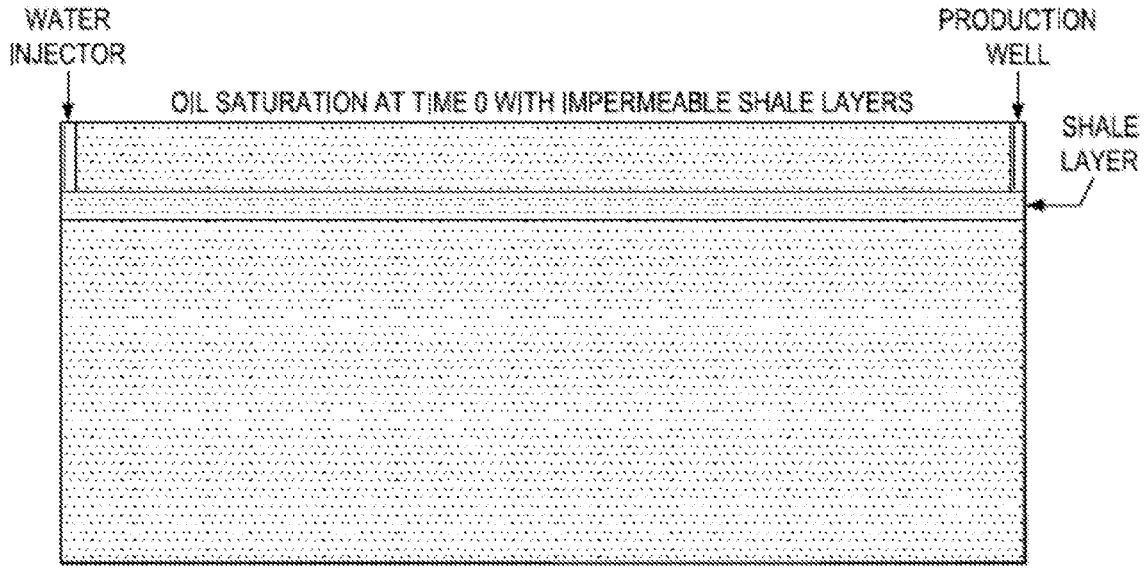
FIG. 5A-B is a simulation of oil saturation of a representative Athabasca reservoir from North Alberta with impermeable layer before 5A and after 5B 7 years of production using RF heating to aid water flood operations in upper layer.
Figure 5B:
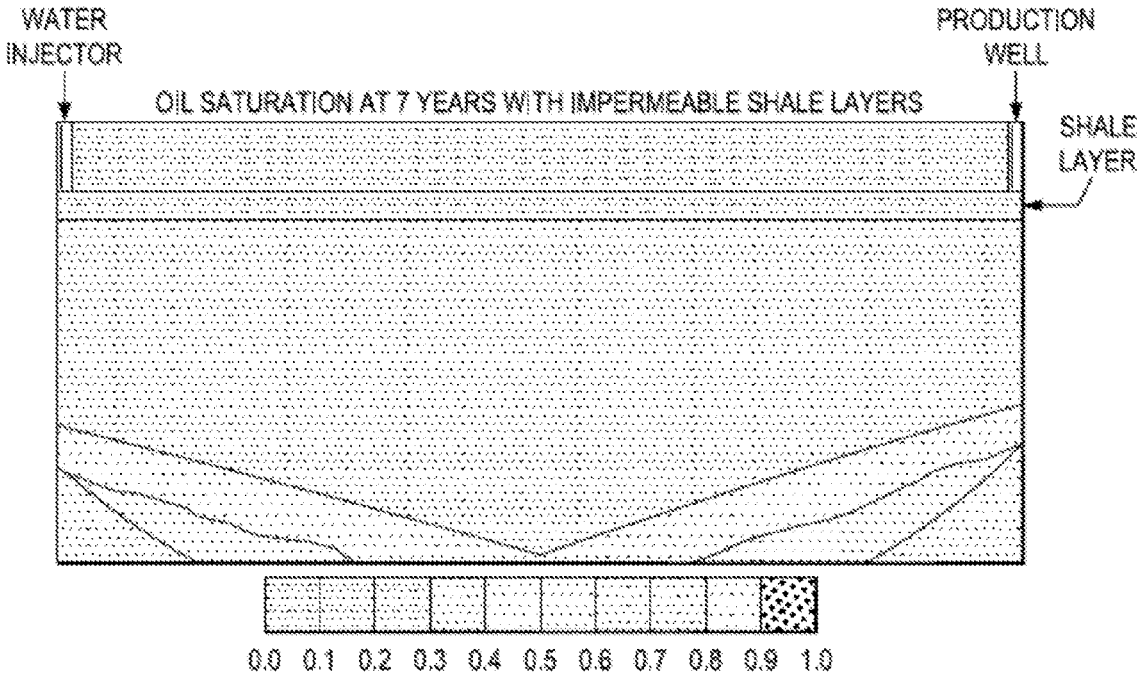

FIG. 5 shows the same reservoir section using magnetic field and eddy current induced joule heating to heat the top section of the reservoir. FIGS. 5*a* shows the oil saturation at initial condition and 5*b* shows the same area after seven years of SAGD production in the lower zone and water flooding in the top zone. The application of the joule heating to the upper section of the reservoir allows the oil's viscosity to be reduced to a level that creates oil mobility under water flooding conductions.

In this case, the electromagnetic field and eddy current induced joule heating heats the top section to 150° C., but flooding applications can be effective in these zones at much lower temperatures. Due to the lower oil viscosity, the upper part of the reservoir is produced, significantly improving the cumulative production from the reservoir.

This process can also be used with slant, horizontal, undulating, multilateral or deviated wells to increase the well's contact area with productive zones. This process can also be used to improve any heavy oil or bitumen production method. Examples of such processes include but are not limited to Cyclic Steam Stimulation, Vapor extraction, J-well SAGD, In Situ Combustion, High pressure air injection, Expanding Solvent-SAGD, or Cross-SAGD (X-SAGD), and the like.

Figure 6:
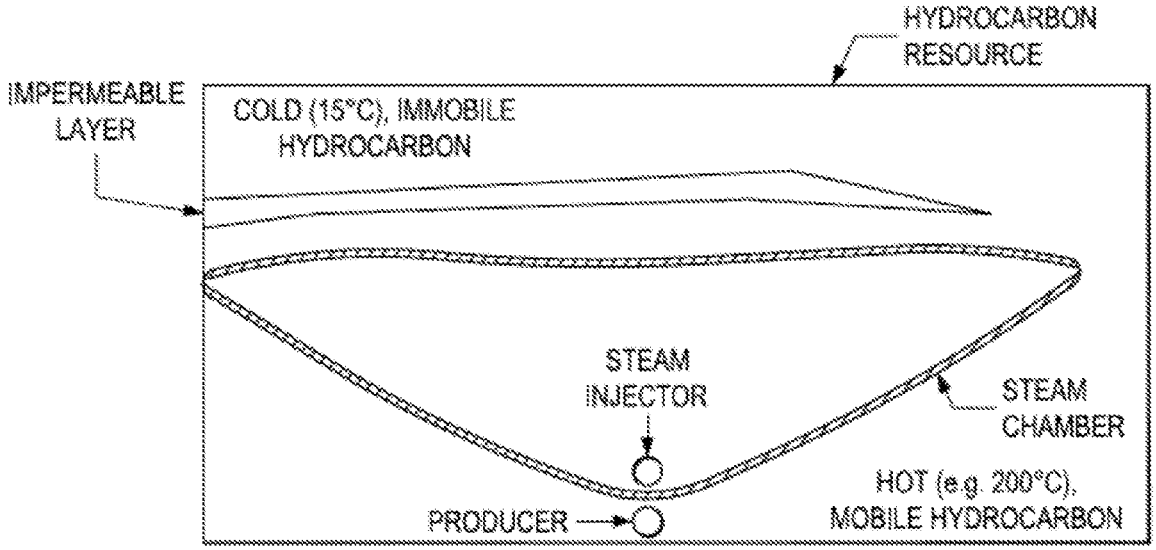
FIG. 6 is a schematic view of a traditional SAGD steam chamber growth in the presence of a partial impermeable layer.

The heating of hydrocarbon formations with magnetically induced eddy currents is also advantageous when the shale layers are not completely continuous across the span of the formation, as seen in FIG. 6. Although the shale may not be a continuously impermeable layer, it may be impermeable over a sufficient span as to cause a "steam" shadow where the steam cannot penetrate into a region, at least within an economical period of time. The hydrocarbon resource in this region will remain at or near the relatively cold initial reservoir conditions. At these conditions the hydrocarbon is immobile and will not drain to a producer in an economical time frame and is thus practically unrecoverable.

Figure 7:
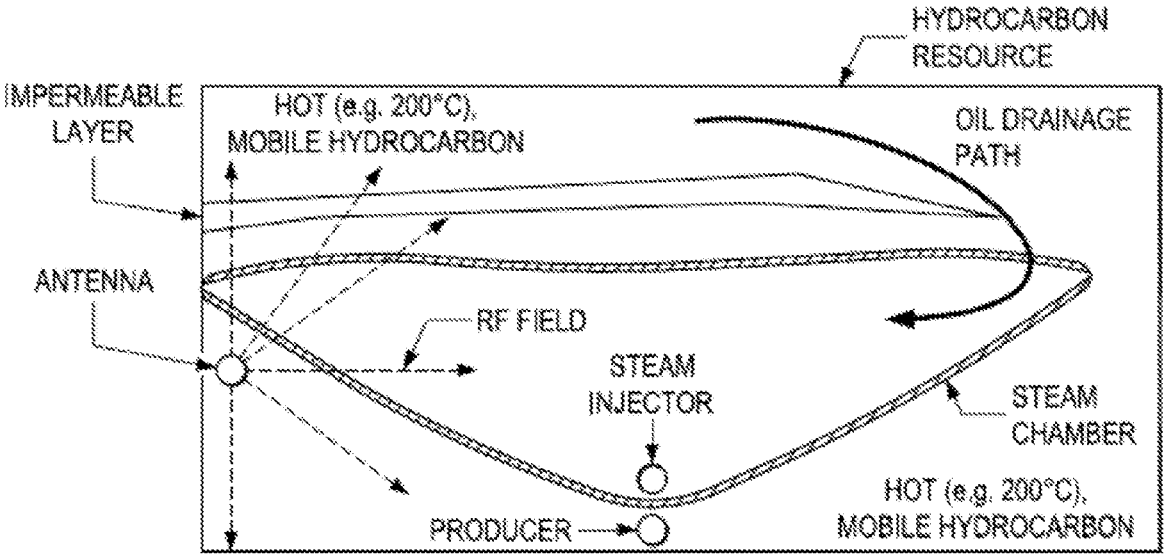
FIG. 7 is a schematic view of a traditional SAGD steam chamber growth in the presence of a partial impermeable layer with the assistance of RF heating energies. Although for simplicity and clarity only a single impermeable layer is shown, the technique is also valid when extended to multiple trapped layers.

As shown in FIG. 7, the present invention introduces an RF antenna at an advantageous location within the hydrocarbon resources such that the magnetic field induces eddy currents and thus heats the region above the impermeable layer. The magnetic field can penetrate through the impermeable (to fluids) layer and heat the resource by inducing eddy currents within the region above the impermeable layer, which in turn causes joule heating inside the region because the eddy currents encounter resistance therein. The heated, lower viscosity hydrocarbon resource above the impermeable layer is now mobile and can drain to a producer as shown schematically in FIG. 7. The location of the antenna shown is only an example location and in practice the antenna could be collocated with an injector or producer well.

The following discussions are illustrative only, and are not intended to unduly limit the scope of the invention.

An antenna invention to produce the planar underground heating will now be described. The antenna may comprise a device as it has a physical structure and its use may embody a method.

Figure 8:
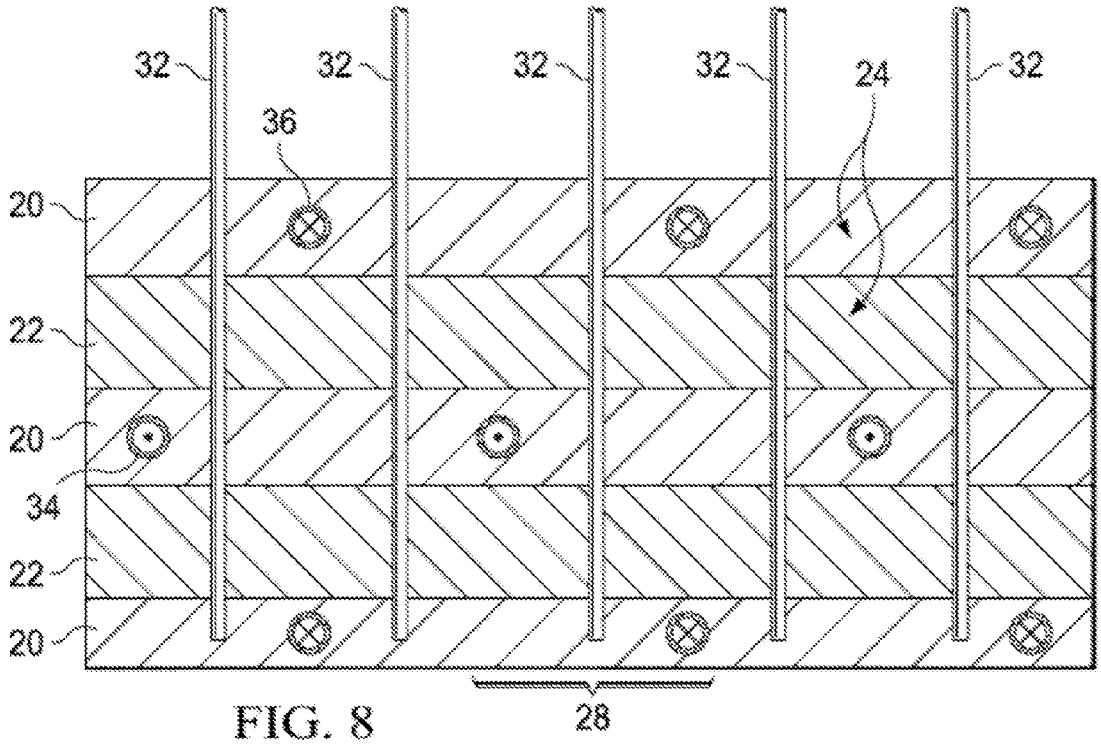
FIG. 8 is a illustrative view of a Linear Antenna Array For Thin Pay Zones.

Referring to FIG. 8, which a cross section view of the implementation of RF antennas, an antenna array 28 is comprised of multiple linear electrical conductors 34, 36 that function as antenna elements. As can be seen, antenna elements 34, 36 of antenna array 28 are located in hydrocarbon-containing pay zones 20 that are divided or separated by shale layers 22.

The linear electrical conductors 34, 36 may be metal pipes or wires and they may preferentially be located in a stratified formation 24. Vertical extraction wells 32 are periodically positioned to extract the warmed hydrocarbons and may contain pumps (not shown) and other features common to hydrocarbon well art. Vertical extraction wells 32 may be coated with electrical insulating compounds (not shown) or electrically nonconductive magnetic compounds (not shown) to prevent electromagnetic interaction with the antenna elements.

The antenna elements 34, 36 may include transmission lines to convey electric currents from a surface electrical power apparatus without excessive power loss in the overburden. The X symbol in the electrical conductors 36 symbolizes current into the page and the dot symbol of electrical conductor 34 symbolizes current out of the page, thus although out of plane in this figure, the antennas are interdigitated (e.g., the currents are anti-parallel).

Electrical conductor 34 may supply electric currents in a time phase different from that applied to electrical conductors 36 to separate electric charges in the underground materials and two or more phase operation is anticipated. As can be appreciated, the linear antennas and the producer wells are staggered far enough away to reduce inductive interaction between adjacent antennas (which would result in heating up the antenna instead of the oil), and close enough together so that the magnetic fields stack, increasing the inductive heating of the oil sand.

Figure 9:
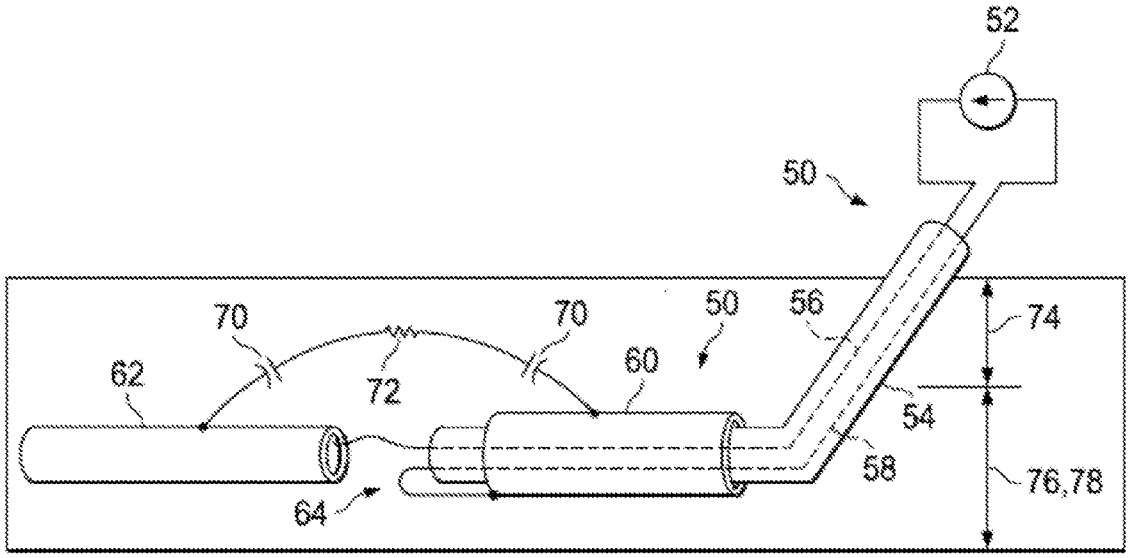
FIG. 9 is a schematic view showing antenna elements and electrical connection of a representative embodiment of the present invention.

FIG. 9 is an electrical schematic of an embodiment antenna element 50 including the linear electrical conductors 34, 36 of the present invention. Electrical current source 52, an alternating current source, provides electrical power to the antenna element 50 at radio frequency oscillations and it is operatively connected to insulated wiring 56, 58. Metal pipe 54 encloses the insulated wiring 56, 58 and it may provide an electromagnetic shield to prevent unwanted heating of the overburden 74 by the electromagnetic fields created by insulated wiring 56, 58.

Transpositions 64 connect the surface electrical current source 52 with linear antenna half elements 60, 62. Linear antenna half element 62 may comprise a metal sleeve electrically insulated from the metal pipe 54 with insulator rings (not shown). Linear antenna half elements 60, 62 may also comprise metal wires, stranded metal braids, or well piping. Linear antenna half elements 60, 62 are preferably positioned in the rock strata 76 or the hydrocarbon ore strata 78, depending on which are more electrically conductive or have higher dielectric permittivity. Note that the electric field is in the form of arcs from one pole of the antenna to the other (in dimensions r and z), whereas the magnetic field forms loops (in dimension θ) encircling the z-axis along which the antenna is aligned.

A method of the present invention is to assess the electrical characteristics of the underground strata a priori, for example by induction resistivity logging, and to position the antenna elements 50 in the more electrically conductive underground regions. This is to ensure the better induction heating effect induced by the RF fields. Numerical simulation methods may predict the underground heating pattern, and specific field shapes may be synthesized to take advantage of the specific geometry present in the underground strata.

Although the invention is not so limited as to only one method of heating, antenna element 50 may couple electric currents into the heated region through capacitance 70 between the linear antenna half elements 60, 62 and the underground materials. This is especially useful if the in situ water is not in direct contact with the linear antenna half elements 60, 62. The heating in the underground strata may be largely provided by joule effect in the formation electrical resistance 72.

The reactance of capacitance 70 is generally adjusted to be less than the formation resistance 72 by selection of radio frequency of the electrical current source 52. As the heating progresses underground, the electrical capacitance $C_s$ to the formation will generally drop and the load resistance of the formation $r_f$ will rise. These changes are somewhat compensatory. The underground in situ water molecules heat preferentially to the hydrocarbons and sand grains. The heated water then conductively heats the associated hydrocarbons by thermal conduction. As an example, liquid water may heat about 200 times faster than bitumen when E fields are applied at a radio frequency of 30 MHz.

In the Athabasca region of Canada, the electrical conductivity of rich bituminous ores may have conductivities σ of 0.002 mhos/meter while the interspersed rock strata may have conductivities of 0.2 mhos/meter, which is 100 times higher. The electrical permittivity of the interspersed underground rock strata is also generally higher. Both of these aspects are therefore used in the present invention for conveying electric currents I and electric fields E to the hydrocarbons and to increase horizontal heating spread.

Figure 10:
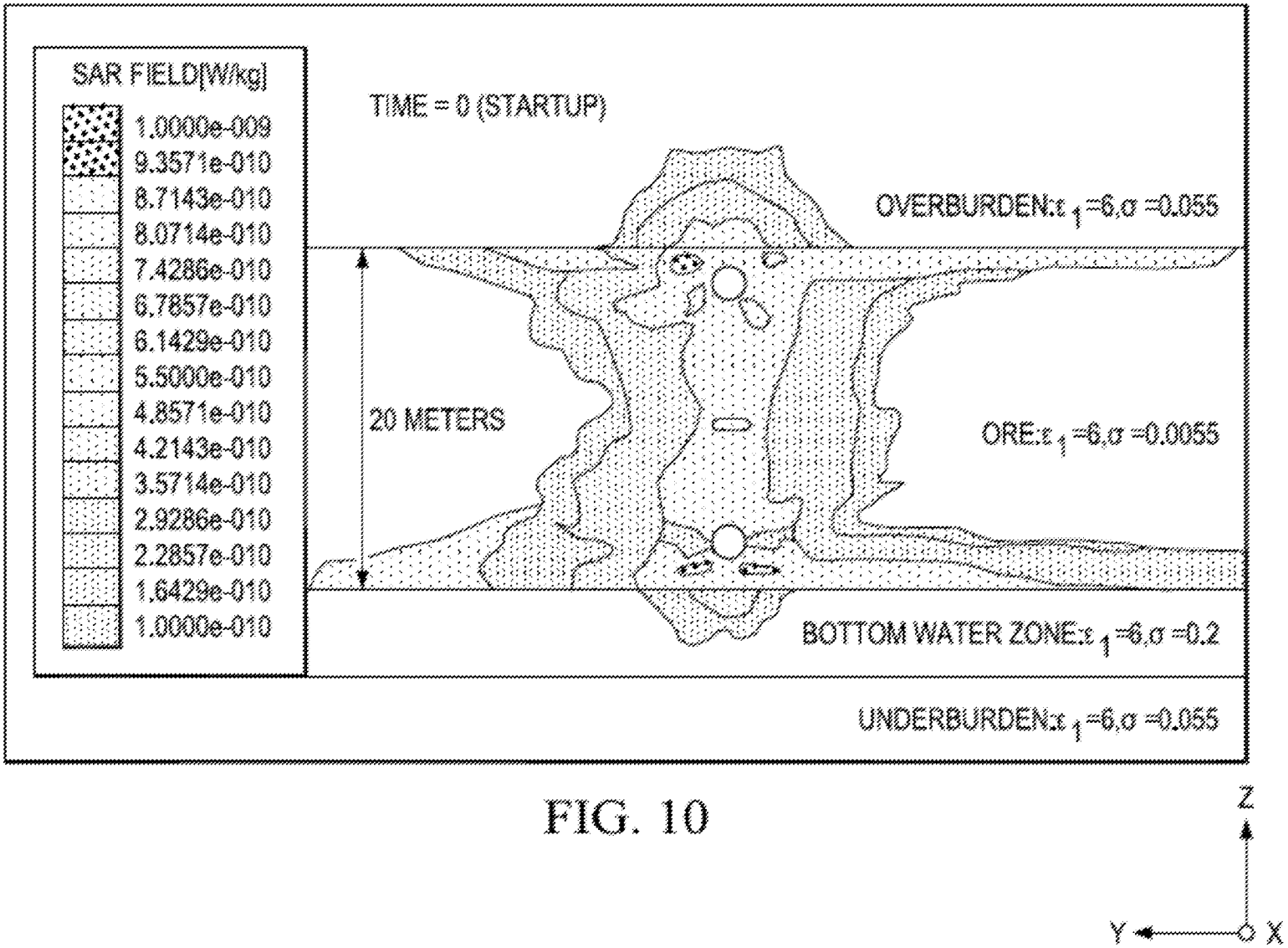
FIG. 10 is a simulation of heating rate pattern of an Athabasca Oil Sands reservoir.

FIG. 10 is a cross sectional view of a two-element linear array embodiment of the present invention, and the antenna elements are oriented into and out of the page. The mapped parameter is Specific Absorption Rate (SAR) in watts per kilogram (W/Kg), which is the rate at which the heating energy is delivered to the heated material. As can be appreciated, layers above and below the hydrocarbon ore are seen to cause a horizontal spread of the underground heating due to their increased electrical conductivity. The heat transfer occurs along the boundary conditions (i.e. at the edge separating the oil sand from the impermeable layers), and the spreading is nearly instantaneous when the RF radiation is first applied.

This boundary condition heat spreading may be enhanced over time as the ore between the linear antenna elements reaches the steam saturation temperature at reservoir conditions. In the simulation, the applied power was normalized to 1 watt. The actual applied power may be 0.1 to 10.0 kilowatts per meter of antenna length in Athabasca formations. As shown in FIG. 10, the effective induction heating range of the RF antenna elements is about 20 meters. However, this range may vary due to different antenna design, power output and the conductance of the pay zone.

By using the method of employing RF antenna array to heat the hydrocarbon reservoirs, especially the ones with horizontal shale layers or mudstones, it is expected that the hydrocarbons inside the reservoirs that could not previously be produced by using convention steam-assisted method can now be produced, which by estimate can increase significant amount of oil production.

What is claimed is:

1. A method of enhancing production of hydrocarbons in a hydrocarbon formation beneath an overburden and having a plurality of stacked pay zones separated by a plurality of steam-impermeable structures, comprising:

a) providing producer wells within the hydrocarbon formation;

b) measuring electric conductivity in the stacked pay zones and the steam-impermeable structures to determine areas having the highest electric conductivity;

c) providing a radio frequency (RF) antenna array within the hydrocarbon formation at said areas having the highest electric conductivity, wherein the RF antenna array having a plurality of antenna elements is connected to an alternating electrical current source oscillating at radio frequencies and wherein adjacent antennas in said RF antenna array are staggered, and wherein said antenna elements are linear dipole elements;

d) generating a time varying electromagnetic field at said antennas, so as to create eddy currents in the stacked pay zones and heat at least a portion of the hydrocarbons predominantly by joule heating; and e) producing the hydrocarbons through the producer wells, wherein the connection between the RF antenna array and the alternating electrical current source is shielded to avoid undesired heating at the overburden.

2. The method of claim 1, wherein the antenna elements are configured in a horizontal configuration within the hydrocarbon formation.

3. The method of claim 1, wherein the antenna elements are positioned inside, beside or around the producer wells.

4. The method of claim 1, wherein the joule heating is accomplished by the eddy currents induced by the RF electromagnetic fields.

5. The method of claim 1, wherein adjacent antennas are about 20 meters apart.

6. The method of claim 1, wherein said antennas are linear dipole antennas, linear half-wave dipole antennas, linear quarter-wave dipole antennas, folded dipole antennas, or coaxial dipole antennas.

7. The method of claim 1, wherein said adjacent antennas are configured as parallel to each other, and said adjacent parallel antennas are arranged in a vertical, diagonal, or horizontal grid pattern.

8. The method of claim 1, wherein said antenna array is arranged to surround one or more of the producer wells.

9. The method of claim 1, wherein currents supplied to said adjacent antennas are time phased such that the maximum and minimum of the magnetic waves are phase-locked with a relative phase difference of 0°.

10. The method of claim 1, wherein currents supplied to said adjacent antennas are time phased such that the maximum and minimum of the magnetic waves are phase-shifted by 180°.

11. A system for enhancing production of hydrocarbons in a hydrocarbon formation underneath an overburden and having steam-impermeable structures, comprising:

a) producer wells having substantially vertical portions in the hydrocarbon formation and substantially non-vertical portions within the hydrocarbon formation, wherein the hydrocarbon is produced through the substantially vertical portions and the substantially non-vertical portions of the producer wells; and b) a radio frequency antenna array having a plurality of horizontal antenna elements connected to an alternating current source through conductive wirings, wherein said radio frequency antenna array is located within said hydrocarbon formation and adjacent antennas elements are interdigitated, and wherein said antenna elements are linear dipole elements;

wherein the radio frequency antenna array generates an electromagnetic field for heating the hydrocarbon formation via eddy currents, and wherein the connection between the RF antenna array and the alternating electrical current source is shielded to avoid undesired heating at the overburden.

12. The system of claim 11, wherein the antenna elements are vertically separated by non-hydrocarbon geological structures.

13. The system of claim 11, wherein the antenna elements are horizontally separated by the producer wells.

14. The system of claim 11, wherein the antenna elements are positioned inside, beside or around the producer wells.

15. An improved method of producing heavy oil in a vertically stratified reservoir, the method being radio frequency (RF) heating the reservoir so as to produce the heavy oil, the improvement comprising arranging an array of RF antennas horizontally within areas having high electrical conductivity such that adjacent antenna currents are phase shifted by about 180° and adjacent magnetic fields are stacked to enhance eddy currents and thus heat the reservoir with predominantly joule heating, wherein said RF antennas are connected to an alternating current source through conductive wirings.

16. An improved method of producing heavy oil in a vertically stratified reservoir, the method being radio frequency (RF) heating the reservoir so as to produce the heavy oil, the improvement comprising arranging an array of RF antennas horizontally within areas having high electrical conductivity such that adjacent antenna currents are generally anti-parallel and thus heat the reservoir with predominantly joule heating, wherein said RF antennas are connected to an alternating current source through conductive wirings.

* * * * *